US009770667B1

(12) United States Patent
Wang-Wu

(10) Patent No.: US 9,770,667 B1
(45) Date of Patent: Sep. 26, 2017

(54) CUP WITH ROTATABLE FIGURINE

(71) Applicant: Ching Yueh Wang-Wu, Tainan (TW)

(72) Inventor: Ching Yueh Wang-Wu, Tainan (TW)

( * ) Notice: Subject to any disclaimer, the term of this patent is extended or adjusted under 35 U.S.C. 154(b) by 0 days.

(21) Appl. No.: 15/197,791

(22) Filed: Jun. 30, 2016

(51) Int. Cl.

| | |
|---|---|
| ***B65D 41/00*** | (2006.01) |
| ***A47G 19/22*** | (2006.01) |
| ***A63H 3/00*** | (2006.01) |
| ***A47G 21/18*** | (2006.01) |
| ***B65D 51/24*** | (2006.01) |

(52) U.S. Cl.
CPC ..... *A63H 3/005* (2013.01); *A47G 19/2227* (2013.01); *A47G 19/2272* (2013.01); *A47G 21/18* (2013.01); *B65D 51/245* (2013.01)

(58) Field of Classification Search
CPC ..... A63H 3/005; B65D 81/366; B65D 2231/022; B65D 51/245; A47G 19/2227; A47G 19/2266
USPC ..... 446/71, 72, 73, 74, 75, 77; 215/228, 215/229, 387, 388; 206/217, 457; 220/709
See application file for complete search history.

(56) References Cited

U.S. PATENT DOCUMENTS 2,544,594 A * 3/1951 Goldfarb ..... A47G 21/182 40/324
2,546,122 A * 3/1951 Goldfarb ..... A47G 19/2222 215/229
2,731,751 A * 1/1956 Green ..... B44C 5/00 215/229
3,285,584 A * 11/1966 Goldfarb ..... A47J 43/1025 366/252
3,834,068 A * 9/1974 Fabricant ..... A63H 33/00 446/200
5,509,551 A * 4/1996 Terrell, II ..... A47G 19/2266 215/229
5,518,143 A * 5/1996 Iodice ..... B65D 77/28 215/229
5,540,611 A * 7/1996 Lapoint ..... A63H 3/005 215/229
5,636,740 A * 6/1997 Finkiewicz ..... B65D 47/0842 206/457
5,769,680 A * 6/1998 Hoffman ..... A47G 19/2227 206/217
6,036,570 A * 3/2000 Nadel ..... A47G 19/2227 446/242
6,766,902 B1 * 7/2004 Hartelius ..... B65D 51/28 206/217
7,025,653 B1 * 4/2006 Hawkins ..... B65D 81/366 206/457
7,029,360 B1 * 4/2006 Hawkins ..... A63H 33/28 206/457
7,140,943 B1 * 11/2006 Hawkins ..... A63H 3/005 206/457
7,264,532 B2 * 9/2007 Chen ..... A63H 29/10 446/200

(Continued)

*Primary Examiner* — Alexander Niconovich

(57) ABSTRACT

A cup generally includes a container body, a lid, a rotatable arm, a straw, and a figurine. The lid is provided with a central hub defining a central through hole. The rotatable arm defines a mounting hole at a first end for fitting over the central hub of the lid. The straw can in inserted into the container body via the central through hole of the central hub. The figurine is fixed at a second end of the arm, so that the figurine together with the arm can be freely rotated around the straw. Thus, the cup can show a unique style and bring more fun to users.

5 Claims, 4 Drawing Sheets

(56) References Cited

U.S. PATENT DOCUMENTS

| | | | | |
|---|---|---|---|---|
| 8,033,889 | B1 * | 10/2011 | Randall | A47G 19/2227 446/267 |
| 8,556,095 | B1 * | 10/2013 | Yamaguchi | B65D 81/366 215/228 |
| 8,701,907 | B1 * | 4/2014 | Mallicoat | B65D 51/245 215/228 |
| 8,727,150 | B2 * | 5/2014 | Lemke | B65D 81/366 215/228 |
| 2006/0201974 | A1 * | 9/2006 | Schuster | A47G 19/24 222/183 |
| 2007/0190894 | A1 * | 8/2007 | Grisoff | A63H 3/006 446/298 |
| 2009/0145874 | A1 * | 6/2009 | Hite | B65D 23/0878 215/227 |
| 2009/0184083 | A1 * | 7/2009 | Cho | B65D 47/06 215/227 |
| 2012/0223044 | A1 * | 9/2012 | Scott, III | B65D 1/0246 215/44 |

* cited by examiner

CUP WITH ROTATABLE FIGURINE

BACKGROUND OF THE INVENTION

1. Field of the Invention

The present invention is related to a cup with a rotatable figurine, which allows the cup to show a unique style and can bring more fun to users.

2. Description of the Prior Art

Commonly, a cup filled with water or a beverage doesn't have any special function or any fun while using the cup. A design or a pattern can be provided on the surface of the cup to produce a unique visual effect on the cup. However, the cup being decorated by a pattern or shape change does not always satisfy the need of a customer pursuing a colorful life. Besides, the pattern shown on the cup is usually created in simple colors, causing the cup to be monotonous and unable to attract customers.

SUMMARY OF THE INVENTION

One object of the present invention is to provide a cup, which includes a lid provided with a rotatable figurine for decorating the cup and bringing more fun to users.

The cup generally comprises a container body, a lid, a rotatable arm, a straw, and a figurine. The container body can be filled with a beverage or drink. The lid, which can be connected with a top portion of the container body, is formed with a central hub defining a central through hole. The rotatable arm defines a mounting hole at a first end for fitting over the central hub of the lid, so that the arm can be freely rotated about the central hub of the lid. The straw can be inserted into the container body via the central through hole of the central hub of the lid for sucking a beverage or drink containing in the container body. The figurine can be fixed at a second end of the rotatable arm, opposite to the mounting hole, so that the figurine together with the arm can be freely rotated around the straw.

One advantage of the present invention resides in that the lid is provided with a decorative figurine which can be freely rotated around the straw to bring users more fun and to produce a unique visual effect on the cup to attract more customers, so that the cup can be sold more easily.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
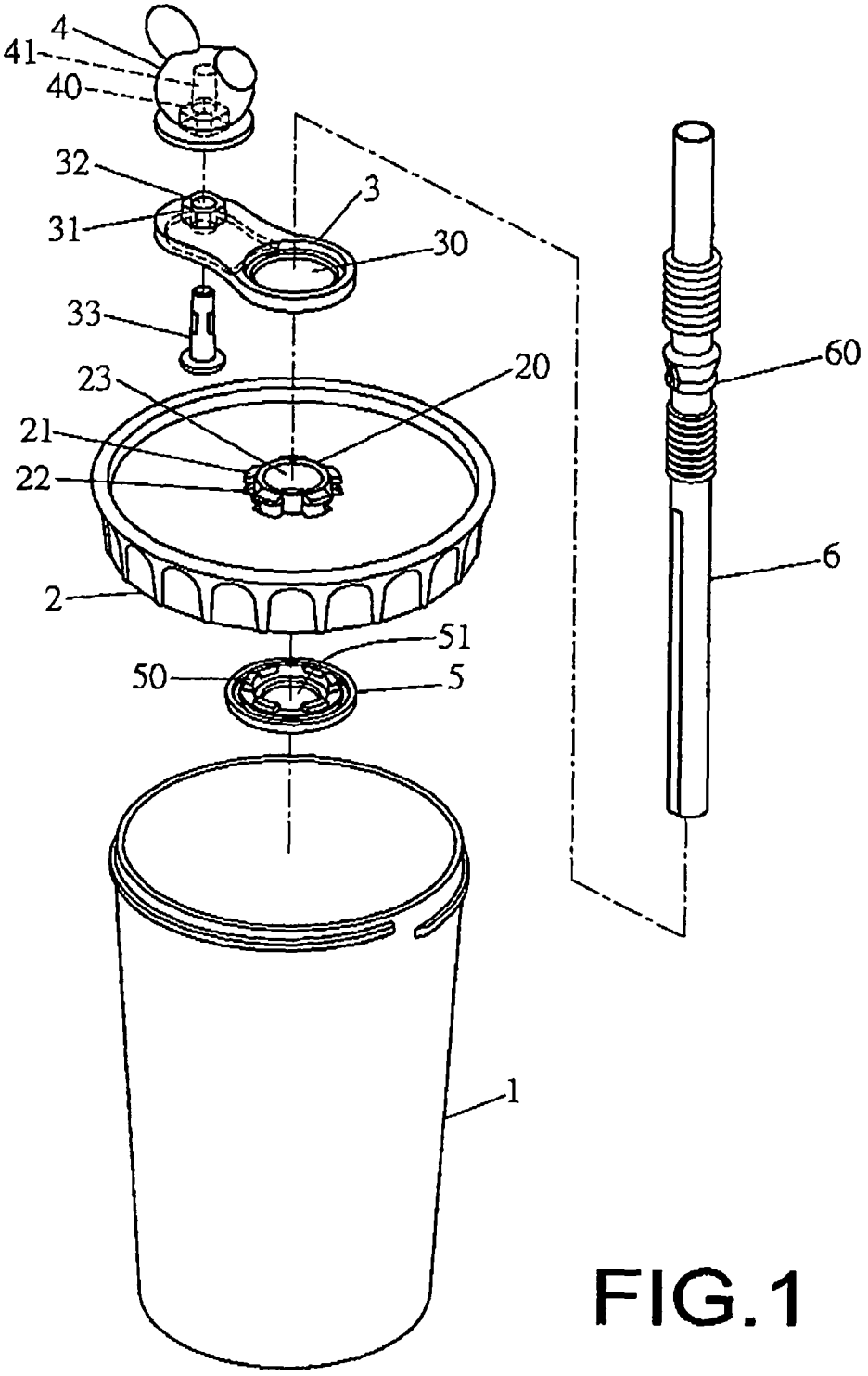
FIG. 1 is an exploded perspective view of an exemplary embodiment of the present invention.
Figure 2:
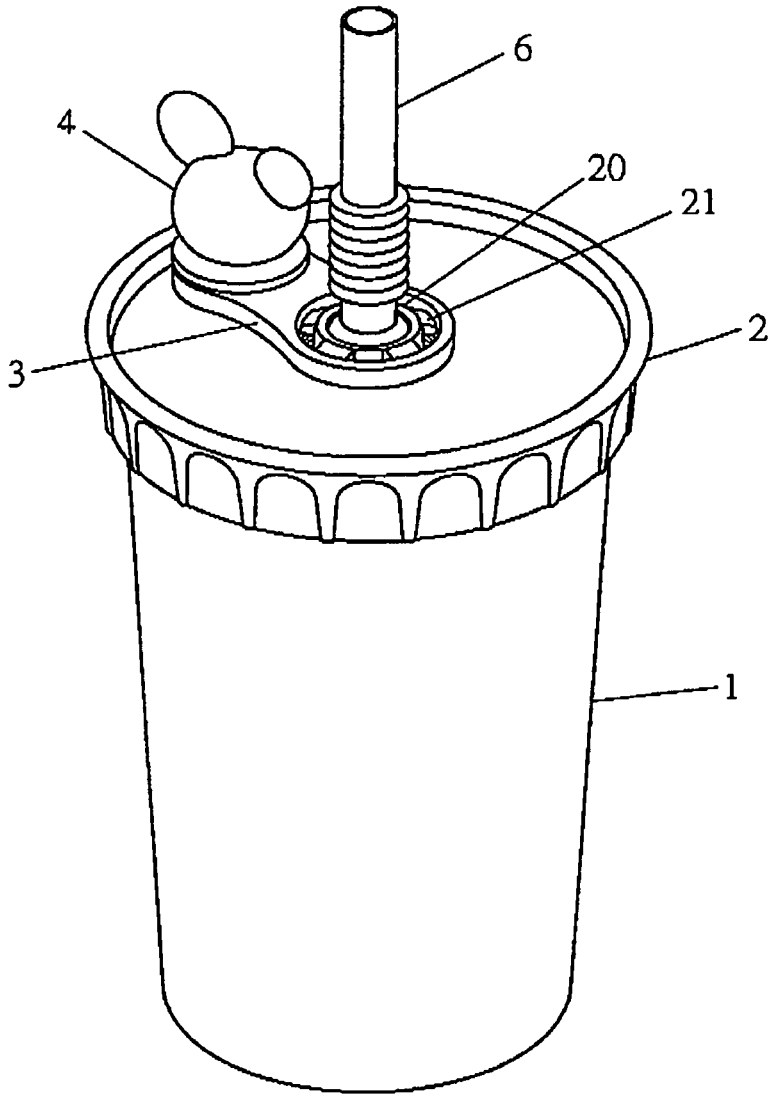
FIG. 2 is a perspective view of the exemplary embodiment of the present invention.
Figure 3:
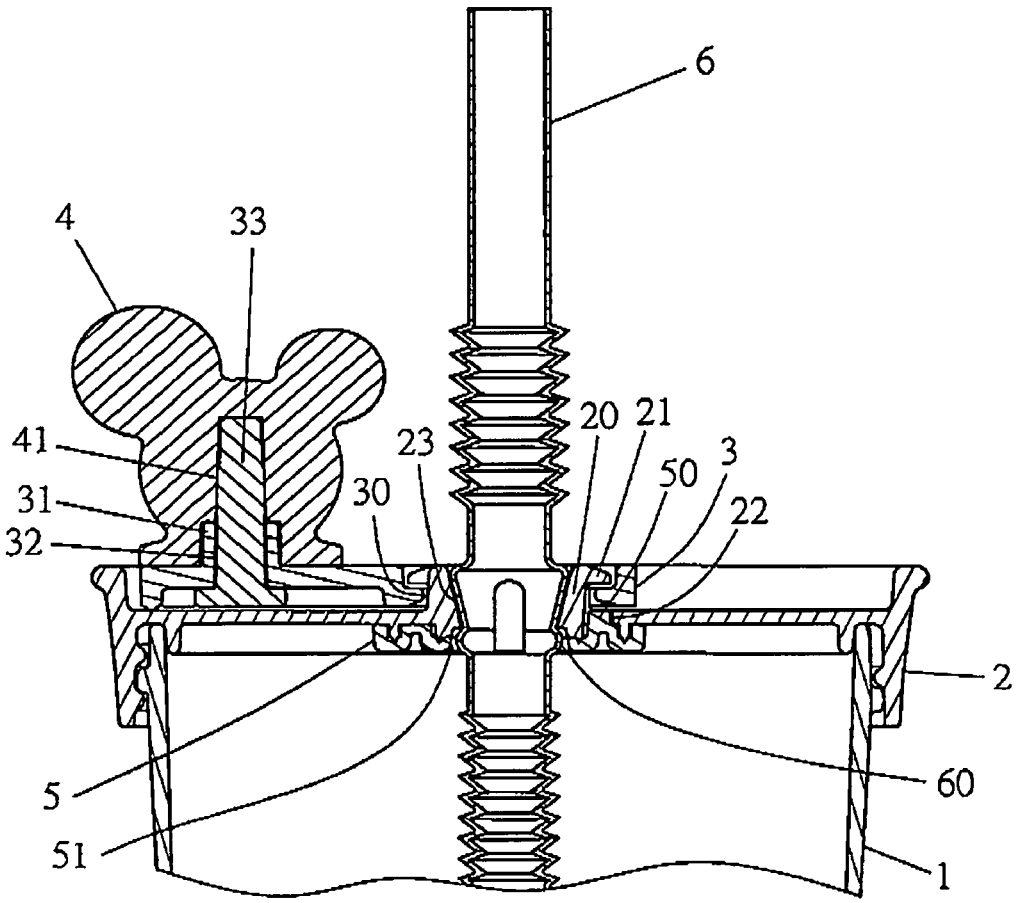
FIG. 3 is a partial sectional view of the exemplary embodiment of the present invention.

Referring to FIGS. 1 through 3, a cup according to one embodiment of the present invention is shown, which generally comprises a container body 1, a lid 2, a rotatable arm 3, a figurine 4, an anti-leaking member 5, and a straw 6. The lid 2 can be connected with a top portion, such as a threaded portion, of the container body 1. The lid 2 is formed with a central hub 20 and defines a plurality of engagement through-holes 22 around the central hub 20. The central hub 20 defines therein a central through hole 23 and is formed at its top with a plurality of tabs 21, which extends radially from an outer surface of the central hub 20 and may correspond to the engagement through-holes 22. The rotatable arm 3 defines a mounting hole 30 at a first end for mounting over the central hub 20 of the lid 2, so that the arm can freely rotate about the central hub 20 of the lid 2. Furthermore, the rotatable arm 3 is formed with a positioning protrusion 31 at a second end opposite to the mounting hole 30, wherein the positioning protrusion 31 defines therein a through hole 32. The figurine 4, which can be designed to have different looks, defines a square recess 40 at its bottom and defines an extension hole 41 on top of the recess 40. The figurine 4 can be fixed on the rotatable arm 3 by inserting the positioning protrusion 31 of the arm into the recess 40 of the figurine 4, and fitting a pin 33 through the through hole 32 of the positioning protrusion 31 of the arm and into the extension hole 41 of the figurine 4, and using ultrasonic welding technique to have the figurine 4, the rotatable arm 3, and the pin 33 formed into an integral structure. The anti-leaking member 5 defines therein a central opening 51 and is formed with a plurality of engagement protrusions 50 around the central opening 51. The anti-leaking member 5 is disposed at a bottom of the lid 2 such that the central opening 51 is aligned with the central through holes 23 of the central hub 20 to allow the straw 6 to be inserted therethrough, and the engagement protrusions 50 can be inserted into the engagement through-holes 22 of the lid 2. Thereafter, the engagement through-holes 22 can be fully sealed by ultrasonic welding. Preferably, the straw 6 is formed with a protruding ring 60, which is given for contacting the bottom edge of the central through hole 23 of the lid 2 to prevent the straw 6 from being easily pulled out of the lid 2.

While assembling the parts of the cup, firstly, the positioning protrusion 31 of the rotatable arm 3 can be inserted into the recess 40 of the figurine 4, and the pin 33 can be fitted through the through hole 32 of the positioning protrusion 31 of the arm and into the extension hole 41 of the figurine 4; thereafter, the figurine 4, the rotatable arm 3 and the pin 33 can be secured together by ultrasonic welding. Secondly, the mounting hole 30 of the arm 3 can be forced to fit over the central hub 20 of the lid 2, wherein the tabs 21 are located above a pepherial edge of the mounting hole 30 of the rotatable arm 3 to prevent the arm from slipping off the central hub 20 of the lid 2. Thirdly, the anti-leaking member 5 is disposed at a bottom of the lid 2 such that the central opening 51 is aligned with the central through hole 23 of the lid 2, and the engagement protrusions 50 are inserted into the engagment through-holes 22 of the lid 2; thereafter, the engagement through-holes 22 can be fully sealed by ultrasonic welding. Finally, the straw 6 can be forced or inserted into the container body 1 via the central through hole 23 of the lid 2 and the central opening 51 of the anti-leaking member 5, wherein the protruding ring 60 can prevent the straw 6 from being easily pulled out of the lid 2.

Figure 4:
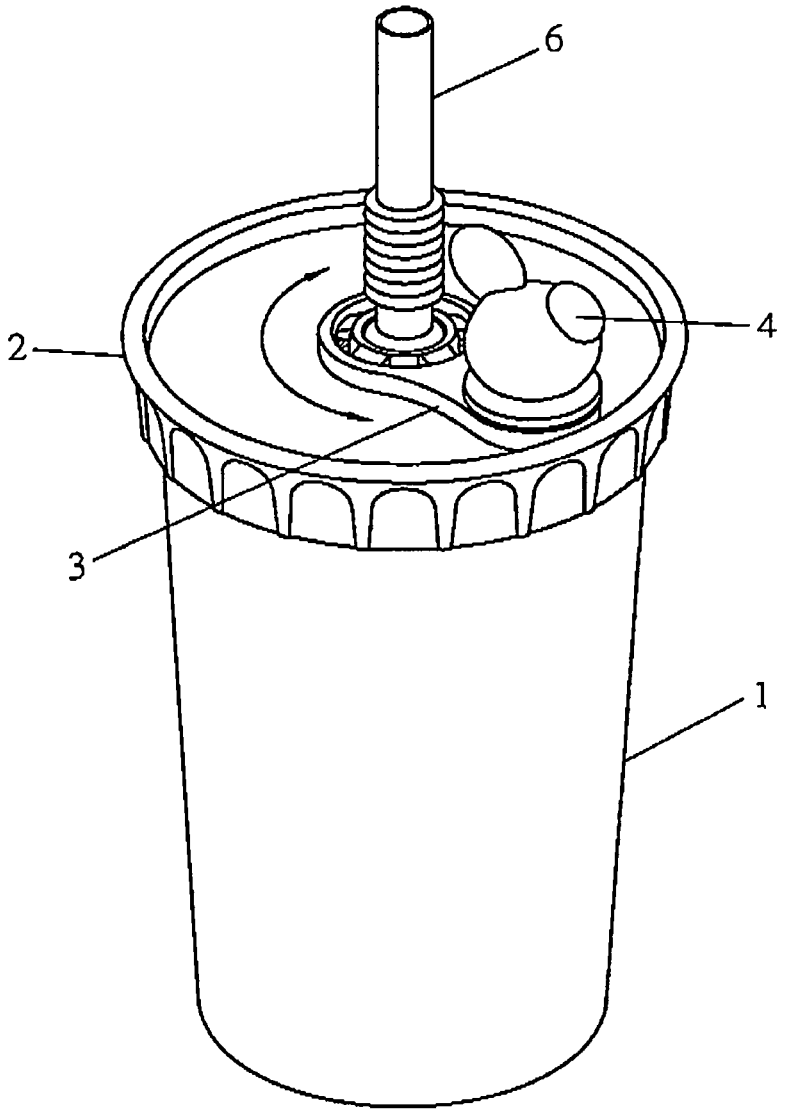
FIG. 4 is a schematically working view of the exemplary embodiment of the present invention.

In use, referring FIG. 4, a user can use the straw 6 to suck a beverage or drink containing in the container body 1 and in the meanwhile, the user can freely turn the arm 3 together with the figurine 4 around the straw 6 for self-entertainment. Furthermore, the decorative figurine 4 can produce a unique visual effect on the cup to attract more customers, so that the cup can be sold more easily.

While the preferred embodiments of the invention have been described above, it will be recognized and understood that various modifications may be made therein and that the claims are intended to cover all such modifications that may fall within the spirit and scope of the invention.

What is claimed is:

1. A cup comprising:

a container body;

a lid capable of being connected with a top portion of the container body, wherein the lid is formed with a central hub defining a central through hole;

a rotatable arm defining a mounting hole at a first end for fitting over the central hub of the lid, so that the arm can be freely rotated about the central hub of the lid;

a straw inserted into the container body via the central through hole of the central hub of the lid for sucking a beverage or drink containing in the container body, and a figurine fixed at a second end of the rotatable arm, opposite to the mounting hole, so that the figurine together with the arm can be freely rotated around the straw;

whereby a user can rotate the figurine around the straw by one hand while sucking a beverage or drink containing in the container body.

2. The cup of claim 1, wherein the rotatable arm is formed with a positioning protrusion at the second end, and the positioning protrusion defines therein a through hole, the figurine defining a recess at a bottom thereof and defining an extension hole on top of the recess, the figurine being-fixed on the rotatable arm by inserting the positioning protrusion of the rotatable arm into the recess of the figurine and fitting a pin through the through hole of the positioning protrusion and into the extension hole of the figurine.

3. The cup of claim 2, wherein the central hub of the lid is formed at its top with a plurality of tabs extending radially from an outer surface thereof to prevent the rotatable arm from slipping off the central hub of the lid.

4. The cup of claim 3, further comprising an anti-leaking member and wherein the lid defines a plurality of engagement through-holes around the central hub, and the anti-leaking member defines a central opening and is formed with a plurality of engagement protrusions around the central opening, the anti-leaking member being disposed at a bottom of the lid such that the central opening of the anti-leaking member is aligned with the central through hole of the central hub of the lid for allowing the straw to be inserted therethrough, and the engagement protrusions are inserted into the engagement through-holes of the lid, the engagement through-holes being fully sealed by ultrasonic welding.

5. The cup of claim 4, wherein the straw is formed with a protruding ring to prevent the straw from being easily pulled out of the lid.

* * * * *